US008424329B2

(12) United States Patent
Wills

(10) Patent No.: US 8,424,329 B2
(45) Date of Patent: Apr. 23, 2013

(54) METHOD AND APPARATUS FOR MAKING AND PRESERVING AN OUTDOOR FROZEN SURFACE

(76) Inventor: Michael E. Wills, Gwinn, MI (US)

( * ) Notice: Subject to any disclaimer, the term of this patent is extended or adjusted under 35 U.S.C. 154(b) by 1009 days.

(21) Appl. No.: 12/013,688

(22) Filed: Jan. 14, 2008

(65) Prior Publication Data

US 2008/0168779 A1 Jul. 17, 2008

Related U.S. Application Data

(60) Provisional application No. 60/884,902, filed on Jan. 15, 2007.

(51) Int. Cl.
*A63C 19/10* (2006.01)
*F25C 3/02* (2006.01)

(52) U.S. Cl.
USPC ..... 62/235; 156/575

(58) Field of Classification Search ..... 62/235; 156/574–575
See application file for complete search history.

(56) References Cited

U.S. PATENT DOCUMENTS 3,166,419 A * 1/1965 Gundlach ..... 430/120.1
3,538,719 A 11/1970 Pradel
3,983,713 A * 10/1976 MacCracken ..... 62/66
4,043,100 A * 8/1977 Aumann et al. ..... 56/16.5
4,467,619 A * 8/1984 Kovach ..... 62/235
4,551,985 A 11/1985 Kovach
4,632,329 A 12/1986 Burley
5,188,700 A * 2/1993 Gilkes ..... 156/575
5,331,826 A 7/1994 Stockhaus et al.
5,771,698 A 6/1998 Abel
5,970,734 A 10/1999 Stillwell et al.
6,122,925 A 9/2000 Rawlins
6,138,387 A 10/2000 Fox et al.
6,672,083 B2 1/2004 Mildengren
6,870,139 B2 3/2005 Petrenko
6,931,874 B2 8/2005 Dawe et al.
6,948,267 B2 9/2005 Parila
6,994,156 B2 2/2006 Kopko
7,124,521 B1 10/2006 Medoro

OTHER PUBLICATIONS

Rinksystems.com online catalog, Ice Markings, Feb. 13, 2005, http://web.archive.org/web/20050213222250/http://www.rinksystems.com/ice_markingp1.html pp. 1-2.*
Home Ice Advantage, Jack Fella, Feb. 7, Southcostal.com, http://web.archive.org/web/20050207023248/http://www.southcoastal.com/history/rink.htm pp. 1-6.*

* cited by examiner

*Primary Examiner* — Frantz Jules
*Assistant Examiner* — Cassey D Bauer
(74) *Attorney, Agent, or Firm* — Bejin VanOphem Bieneman PLC

(57) ABSTRACT

The invention is an apparatus and method of creating and preserving an outdoor frozen surface by covering a defined outdoor ground surface with a layer of white base paper after clearing debris, litter, and other objects from the defined surface which may present a hazardous condition on an ice surface. The layer of white base paper is saturated with water at near freezing or under freezing conditions to allow the water to freeze and hold the white base paper to the defined outdoor ground surface. Thereafter, water is continuously dispensed under freezing conditions to build up a predefined thickness ice layer on the defined outdoor ground surface.

4 Claims, 5 Drawing Sheets

METHOD AND APPARATUS FOR MAKING AND PRESERVING AN OUTDOOR FROZEN SURFACE

CROSS-REFERENCE TO RELATED APPLICATIONS

This application claims the benefit of U.S. Provisional Patent Application Ser. No. 60/884,902, filed on Jan. 15, 2007.

STATEMENT REGARDING FEDERALLY SPONSORED RESEARCH

Not applicable.

REFERENCE TO A SEQUENCE LISTING

Not applicable.

FIELD OF THE INVENTION

This invention relates to a manner of making and maintaining an outdoor ice surface for winter recreational or sporting events, competitions or automotive vehicle performance validating. In particular, this invention relates to a new approach to create and preserve outdoor ice tracks for purposes of evaluating vehicle performance during cold weather conditions.

BACKGROUND OF THE INVENTION

A portion of every vehicle's new development cycle includes validating vehicle performance or components for automotive vehicles under cold weather conditions. Therefore, as part of a new vehicle development program, during the winter months, a team of engineers is dispatched to cold weather areas of the Midwest with the vehicles to be tested, to carry out a group of predetermined tests under cold weather conditions so as to evaluate the performance of the vehicles or components thereof under predetermined wintry conditions. For this purpose, most original equipment manufacturers have facilities in cold weather areas in the northern areas of the Midwest where winter conditions provide an appropriate environment to validate the vehicle's performance or components thereof under ice and snow conditions. Obviously, the occurrence and completion of these tests depends almost completely upon the temperament of the environment. Since the performance of these cold weather tests are completely subject to nature's elements, it is not unusual for a team of engineers with the vehicles or components to be tested to arrive at the test site and as a result of either weather changes or surface condition changes, they are unable to carry out the test or must wait for the proper climatic conditions in order to carry out the testing. This results in a significant loss of time by the test team, as well as great expense to the owner of the test facility in an attempt to maintain the surface conditions necessary to complete the testing.

In the past, many of these test sites were prepared prior to arrival of the test team by painting the surface upon which the tests were to be completed with a white paint. Thereafter, water would be floated onto the test track under freezing conditions so that the proper surface conditions could be acquired for testing to begin. Generally, ice thicknesses would be built-up to between five and six inches thick on the test track to prevent the loss of an ice surface during sunny days. Some melting was tolerated because overnight freezing temperatures would refreeze the melted portion. Snow was tolerable since it could easily be swept from the ice and if necessary a single pass of light water spray could recondition the surface to an acceptable frozen condition so that testing could be continued.

Although the white paint was very helpful in maintaining the ice surface, especially during sunny days, there were significant cost problems with the maintenance of the ice surface since the substrate which was normally concrete, had expansion strips buried into the substrate, which is normal, to compensate for expansion of the concrete material during the climatic changes. Unfortunately, the expansion strip was made from some form of an asphalt material which resulted in the expansion strip areas absorbing much more heat than the remainder of the substrate and therefore, the icy surface condition would change very rapidly in the area of the expansion joints and become unusable for purposes of testing the performance of the vehicles or components thereof. Again, as set forth above, the testing had to wait for the appropriate surface conditions to materialize naturally resulting from changing climatic conditions. Further, the use of white paint on a substrate also required high maintenance, in that, chipped areas or cracks acquired during warmer climates would have to be repainted, or resealed and repainted each year before building up an ice surface. Also, under normal conditions it was necessary to repaint the surface at least every other year. Therefore, every other year the painted areas had to be stripped and a new coat of fresh white paint needed to be reapplied. Some facilities just did not choose to incur such annual expense since some of these test facilities are as large as five acres. In such case, on sunny days, testing was limited, especially on asphalt surfaces, where the ice would be partially thawed resulting in unacceptable surface conditions for ongoing tests. It has been known in severe unstable conditions that the complete test team, including vehicles, had to be shipped to further northern areas of the world in order to ensure completion of the test conditions so as to validate the performance of the vehicles or components thereof in these extreme environmental conditions.

What is needed then is a test facility for automotive winter testing that can economically create a frozen surface, maintain and preserve this surface so that the cold weather test can be completed more efficiently without excessive cost and loss of time due to climate changes. Further, the creation of a frozen surface that provides these features is also useful for winter recreational purposes and winter sporting events.

BRIEF SUMMARY OF THE INVENTION

The invention is an apparatus and method of creating and preserving an outdoor frozen surface by dispensing, on a cleared defined outdoor surface, at least one layer of white base paper followed by saturating the at least one layer of white base paper with water at or near freezing conditions. After the saturated layer of water has frozen into a layer of ice to hold the at least one layer of paper to the defined outdoor frozen surface area, a tanker truck is used to continuously dispense water under freezing ambient conditions onto the defined outdoor frozen surface to build up a predefined thickness ice layer on the defined outdoor surface.

It is an object of the present invention to create and maintain a frozen surface for recreational, sporting, or testing purposes wherein the frozen surface degrades as a result of exposure to the sun at a slower rate than prior art frozen surfaces.

It is another object of the invention to create and maintain a frozen surface for recreational, sporting, or testing purposes wherein the frozen surface can be created on asphalt, concrete or grassy surfaces by first placing at least one layer of white paper on the area intended to be used as a frozen surface and thereafter dispensing water onto the layer of paper until a required thickness is attained.

It is a further object of the invention to create and maintain a frozen surface for recreational, sporting, or testing purposes that will be more consistent throughout as a result of exposure to sunlight during daylight hours in the winter time.

It is a further object of the invention to create and maintain a frozen surface that requires less time to construct and is significantly thinner than prior art frozen surfaces yet less susceptible to degradation due to sunlight exposure during daylight hours in the winter months.

It is a further object of the invention to create and maintain a frozen surface that is more economical to maintain than prior art frozen surfaces exposed to sunlight during daylight hours in the winter months.

These objects and other features, aspects, and advantages of this invention will be more apparent after a reading of the following detailed description, appended claims, and accompanying drawings.

DESCRIPTION OF THE PREFERRED EMBODIMENT

In general, the method of the present invention creates and maintains a frozen ice surface which has a much greater resistance to partial thawing as a result of exposure to sun during the daytime so that the surface can continue to be used for its intended purpose without significant loss of time or delay whether such purpose is recreational or otherwise. Initially, the invention was created to facilitate testing vehicles or their components in a cold weather environment. However, the method of the invention is also usable for winter recreational purposes, as well as winter sporting events.

The method of the present invention results in an ice surface which maintains its integrity for longer periods of time resulting in significant savings in the case of automotive vehicle performance testing, as well as assures greater confidence in recreational or sporting events occurring as scheduled and not being canceled due to poor ice conditions. According to an embodiment of the present invention as shown in FIGS. 1-8, the surface area 10 intended to be covered with ice first needs to be cleared of all debris, stones, or large objects which may present an obstacle for the equipment that is used to create and maintain the frozen surface or for safety purposes. Obviously, if the intended area has already been paved with either concrete or asphalt, this requirement becomes almost insignificant, while if it is an open field area with grass, appropriate efforts must be made to at least provide a relatively clear surface without any form of obstacles where injury may occur to the user of the frozen surface to be created.

Figure 1:
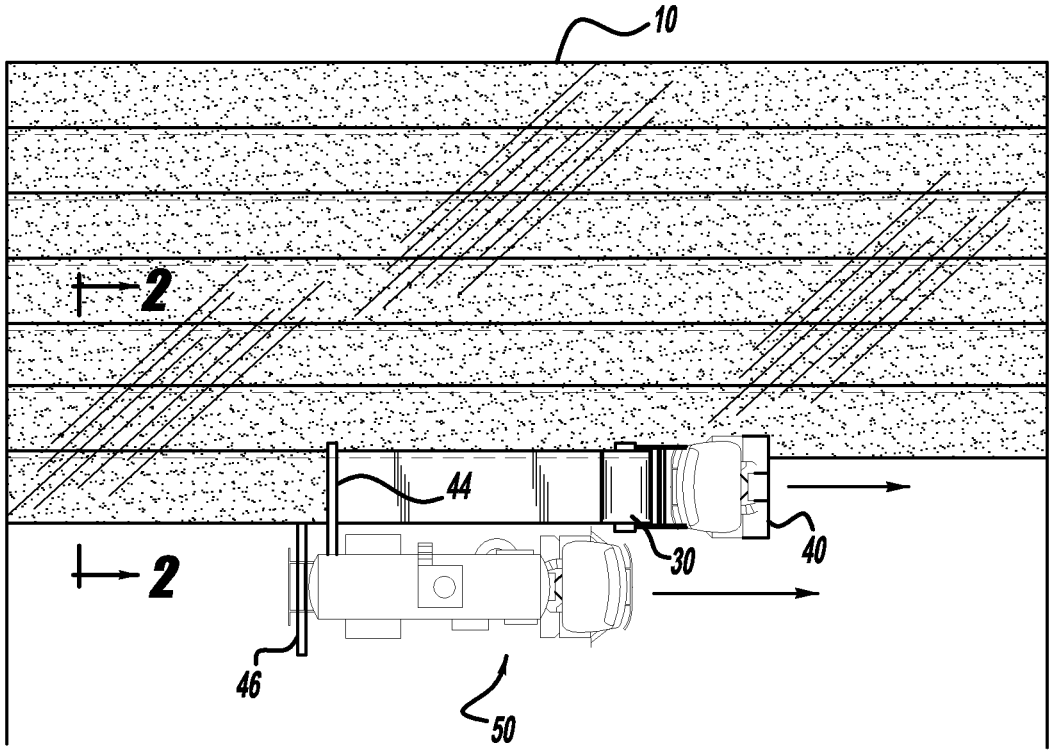
FIG. 1 is a top view of an outdoor area being prepared for the creation of a frozen surface.
Figure 2:
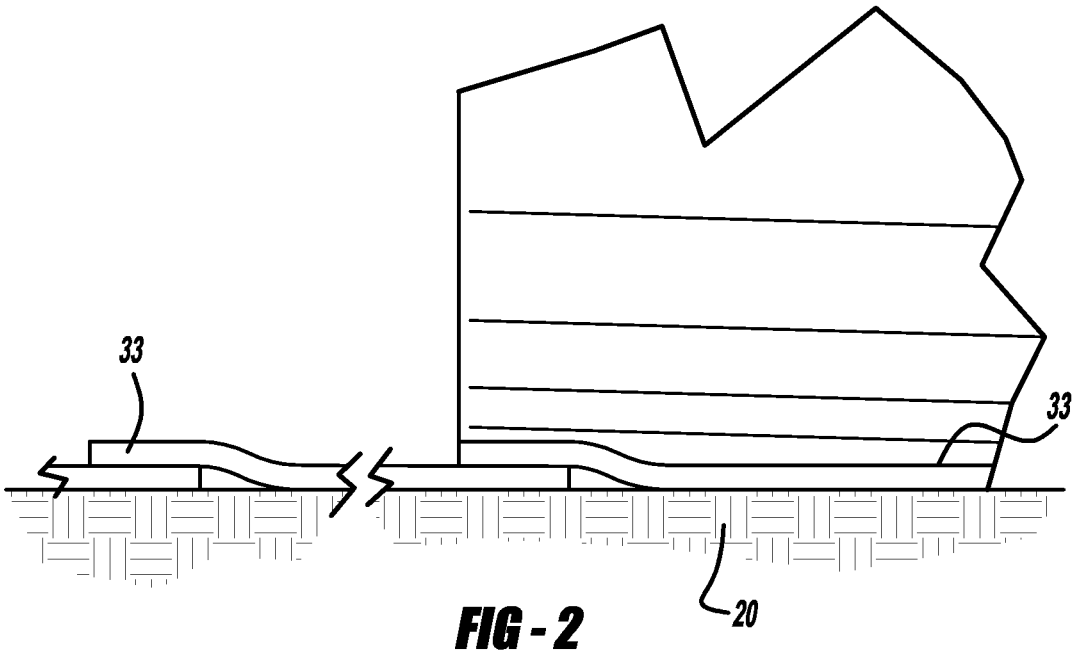
FIG. 2 is a section view taken along arrow 2-2 of the substrate of the surface area on which a frozen surface will be created illustrating the dispensing of a single layer of white base paper.
Figure 3:
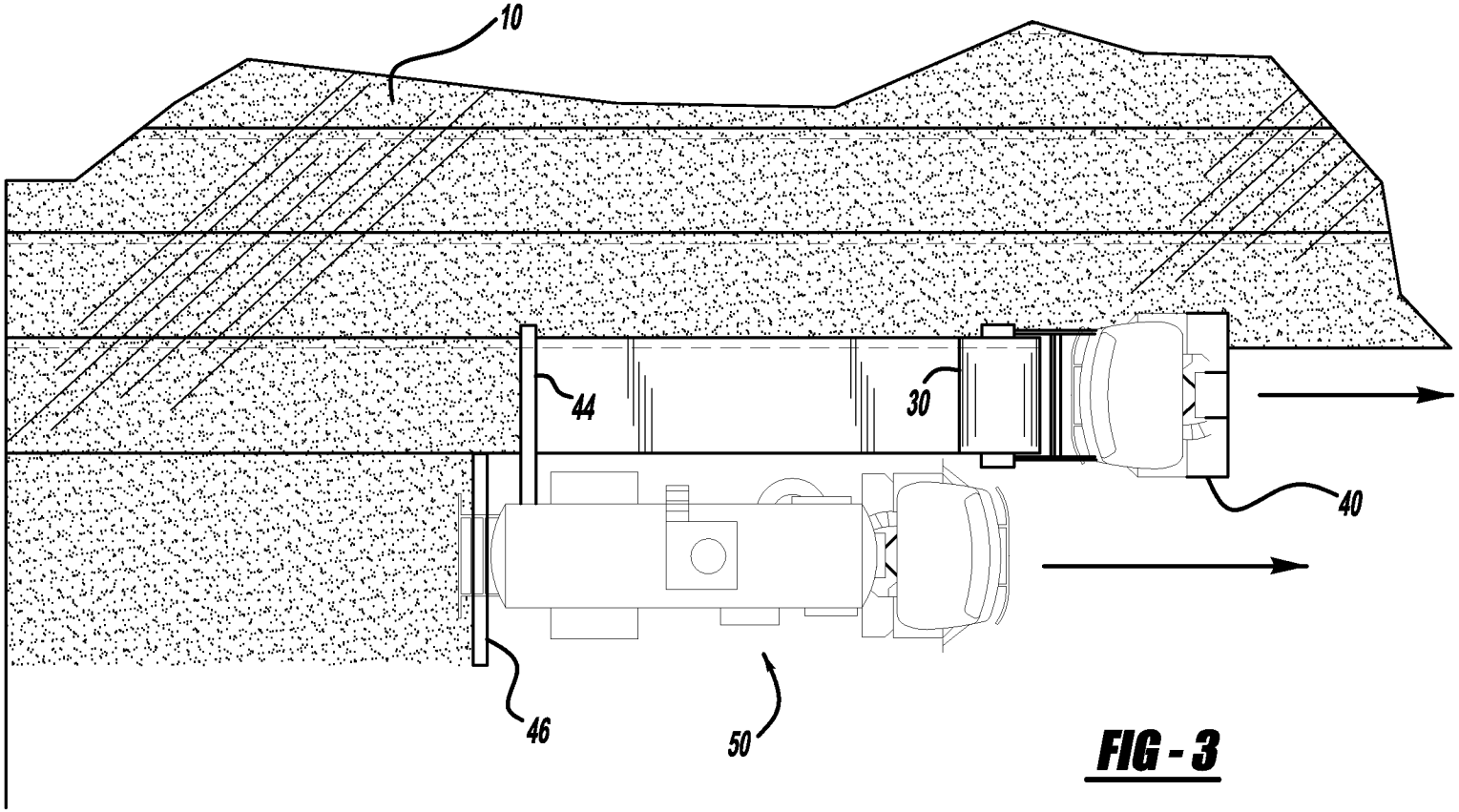
FIG. 3 is a top view of the inventive method, shown in FIG. 1, which illustrates water being dispensed from the side, as well as the rear water line with nozzles therein.

For surfaces that have either a concrete 20 or asphalt (not shown) substrate, as shown in FIGS. 1 and 2, the method of the invention requires that the surface be covered with a layer of white base paper 33 as shown. For this purpose, a roll of paper 30 is mounted on a freely rotatable axle rod 35 mounted to the front-end of a front-end loader 40 or any other convenient movable vehicle used as a dispensing vehicle. The vehicle 40 traverses the complete area to be covered by unrolling the roll of paper 30 and creating adjacent rows, as shown in FIGS. 2 and 3, of dispensed paper 33 At same time that the paper is unrolled, the paper layer 33 is wetted down using standard tap or well water 42 by the use of a source of water such as a tanker truck 50 which is adapted with an extended pipe 44 which overhangs the paper layer to wet the water, by gravity feed, on the paper layer 33 as it is unrolled by riding alongside each paper layer 33 as it is dispensed from the roll of paper 30 as shown in FIGS. 1 and 3 or alternatively, the tanker truck 50 can follow the front-end loader or paper dispensing machine 40 and spray the water 42, which is gravity fed, through a dispensing pipe 46 attached at the rear of the vehicle, so as to wet down dirt before the paper is laid on the dirt and sprayed with water. This process is preferably done at below freezing temperatures. However, it is possible that the initial dispensing of a single paper layer 33 could be done above or near freezing temperatures as the water 42 will keep the paper layer 33 adhered to the substrate and as long as it freezes overnight, the water 42 will freeze into ice to hold the paper layer 33 to the substrate.

Figure 4:
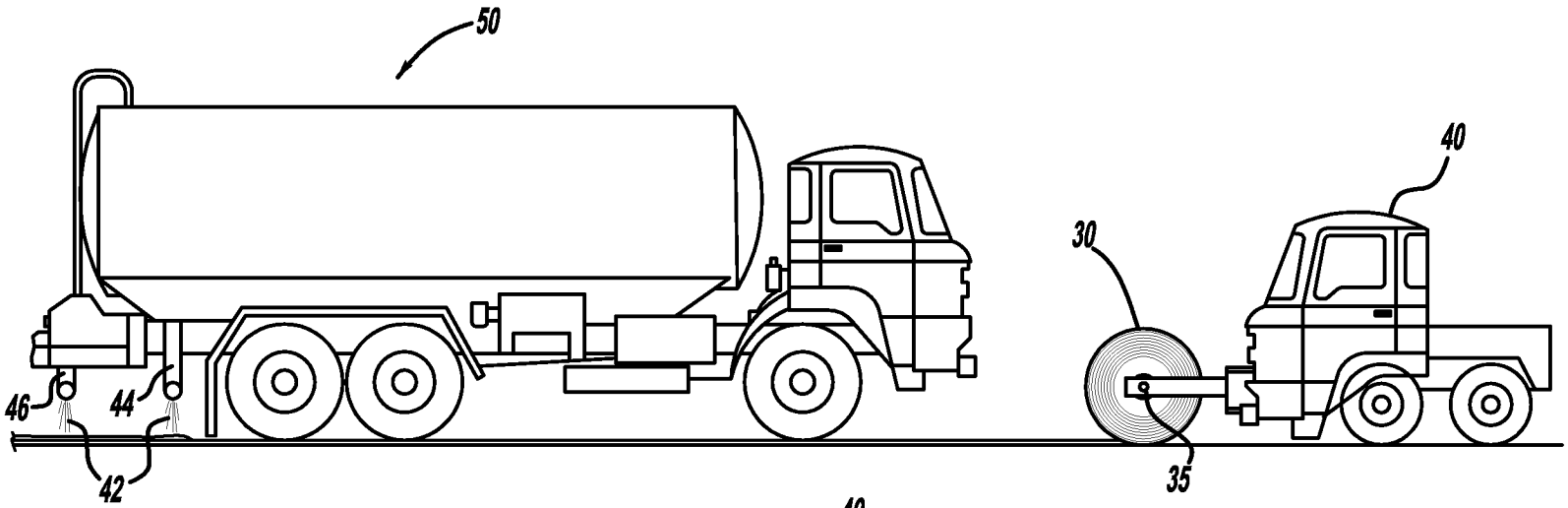
FIG. 4 is a side view of the paper dispensing machine, as well as the tanker truck or water dispensing apparatus as shown in FIG. 1.

Depending upon the type of substrate used, or the nature of the ice surface to be formed, most areas that have a concrete substrate are adequately covered with a single layer of paper 33 whereafter the water dispensing tanker 50, as illustrated in FIG. 4, continues to dispense water 42 under freezing conditions until a thick layer of ice is built-up. As stated in the Background of the Invention, the usual thickness of the layer of ice in the prior art was five to six inches when the prior art method was used, wherein the concrete 20 was first painted with white paint. However, using the current method of covering the substrate of concrete 20 with a white paper layer 33 first, the ice is built-up to between one and a half to two inches by subsequent passes of the water dispensing tanker 50 once the initial layer of paper 33 has been laid down.

In practicing the invention, it has been found that a single layer of paper 33 using a concrete substrate 20 is normally sufficient in order to obtain an ice surface which will reflect the sun during sunny days and maintain the ice surface into a usable condition. It has been found that the ice surface can be maintained in a usable condition two to three times longer than prior art ice surfaces. This is believed to be due to reflective characteristics of the sub-layer of white paper 33 and even if expansion strips are present or darkened concrete sections exist, the paper layer 33 evenly covers any form of expansion strips or darkened surface that may exist in the substrate so that the ice surface will maintain a more even consistency during those daylight hours when the ice is exposed to sunlight. Since the complete test track or frozen surface area 10 has the same basic reflection characteristics, the ice conditions are much more even throughout the total test track area and accordingly, testing of vehicles or components thereof can be continued even during sunny days since the whole test track ice is completely consistent even though the ice thickness is only one-third of the thickness of the prior art surfaces. Further, as in the past, if snow falls, the ice is either broomed or scraped to remove the snow therefrom and it is then ready for use for its intended purpose. In the Preferred Embodiment, the roll of paper 30 is obtained directly from the paper mill and is semi-processed paper approximately 0.022 thick but it is believed that any thickness of paper can be used providing that the consistency is such so that it does not rip or tear while it is being dispensed from the paper laying machine 40. It is possible where the substrate is a concrete 20 material to use more than one layer of paper 33, in that, the additional layer does provide additional reflection characteristics which will help to maintain the ice for a longer period of time. However, a single layer will preserve the ice surface at least two to three times longer, under sunny daylight conditions than prior art surfaces. It is, of course, expected that the temperature during nighttime hours will be below freezing. Clearly, the best conditions are when the temperatures during the night and day stay below freezing.

During test application it was found that when the first layer of paper is dispensed and wetted down by the water there is some bubbling of the paper. This bubbling is subsequently covered with ice as the water source 50 sprays additional water 42 on the paper layer 33 so as to build up the ice to its one and a half to two inch thickness. So the bubbling does not become a problem once the surface is built-up, in that, it is buried deep within the ice.

Figure 5:
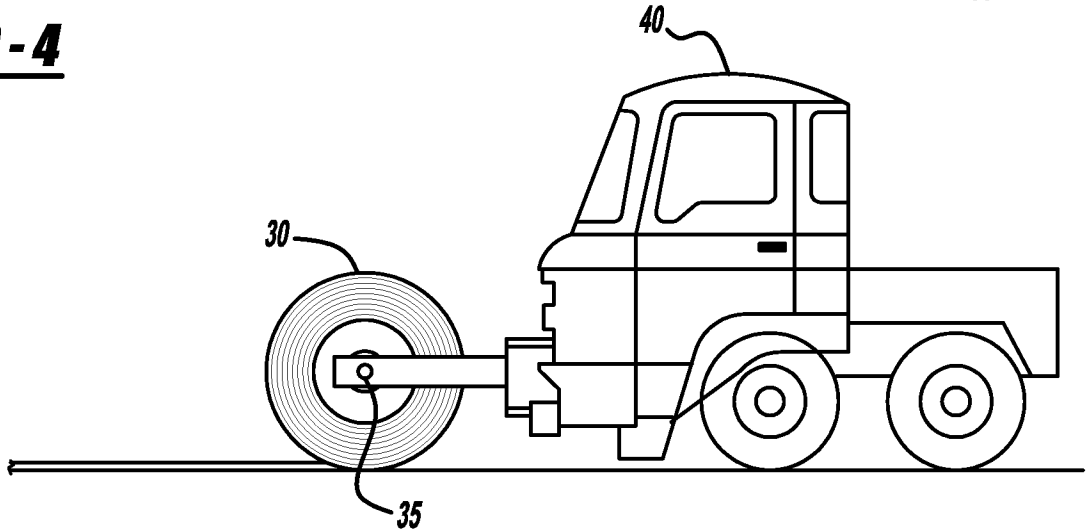
FIG. 5 is a side view of the paper dispensing apparatus.

If the substrate material is an asphalt material, it is recommended that a double layer of paper 33 is used in order to get the reflection characteristic necessary to prevent the ice from melting during sunny days. Again, as with concrete, once the paper is laid down by the paper dispensing apparatus, as shown in FIG. 5, and the ice thickness is built-up to one and a half to two inches, the surface condition is much more consistent throughout the area as compared to prior art techniques. Accordingly, the method used for either a concrete or asphalt substrate is basically identical with the exception that it is recommended that the asphalt substrate be provided with a double layer of paper 33 prior to the built-up of the ice surface to one and a half to two inches or more if necessary.

The method used to maintain a frozen surface as disclosed herein has been attempted with plastic and foil layers but neither material results in equivalent ice surface characteristics as those obtained using white base paper.

The invention has also been practiced on a dirt or grassy surface and works equally well but requires a further condition. When it is necessary to create an ice surface on a grassy surface, again, the surface must be clean of debris which could interfere with the use of the ice surface once it has been built-up. However, the first step in creating an ice surface on a grassy substrate is to put down a layer of water 42 with the water source 50, as shown in FIG. 3, and allow it to freeze before the paper layer is dispensed on the grassy surface. After spraying the area with a water application, the paper is dispensed in single adjacent layers 33 as shown in FIG. 2 and of course covers the area intended to be used for the ice surface. A second layer is also recommended for the application of creating an ice surface on a grassy area, and in such case, the second layer is criss-crossed with the first layer and applied by wetting the paper 33 as it is unrolled and laid on the grassy surface. Thereafter, the water source or tanker truck 50 will build up the ice to the appropriate thickness, as necessary, by spraying additional water on the layers of paper. Like the surfaces that are built on either concrete or asphalt, the ice surface which is created using this technique, will last two to three times longer and will be less effected by a sunny day in terms of meltdowns because of its consistency and accordingly, such application would be recommended for outdoor recreational or sporting events. As with concrete and asphalt surfaces, it is understood that overnight conditions must be freezing to maintain the ice surface for extended periods.

Whether the method is practiced on a concrete, asphalt, or grassy substrate, once the environmental conditions are no longer conducive to forming ice, as in the spring time, the paper is gathered and disposed of through acceptable waste disposal facilities.

Figure 6:
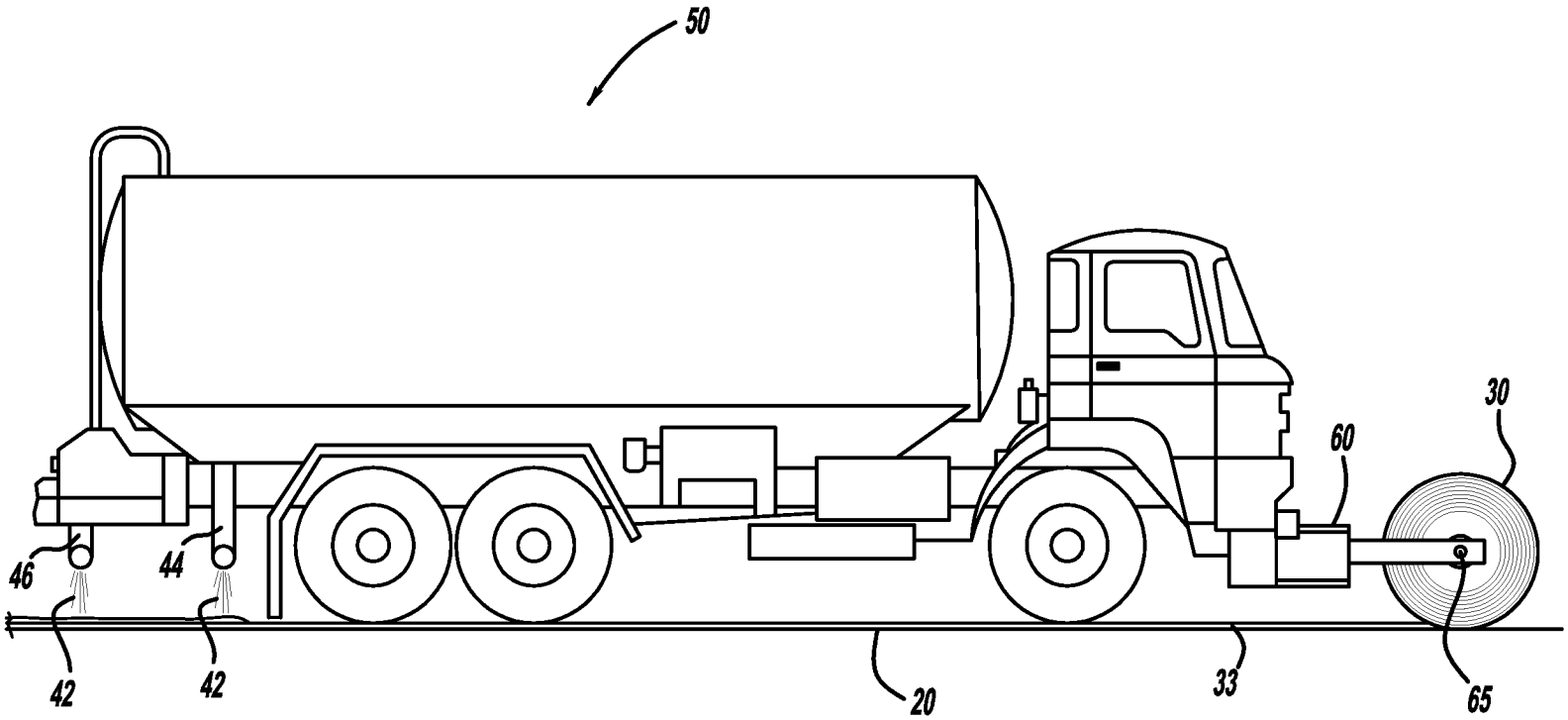
FIG. 6 is a side view of an alternate arrangement of the method of dispensing the paper and the application of a first coat of water.
Figure 7:
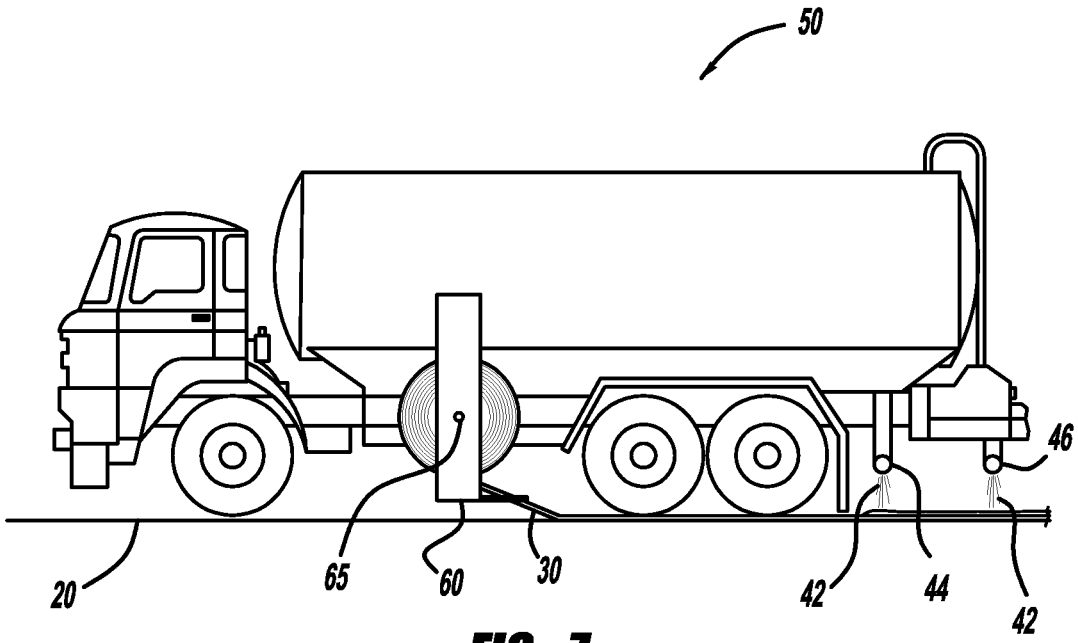
FIG. 7 is a side view of a tanker truck that has been converted to carry the roll of paper so as to dispense the paper, as well as the water using a single vehicle.
Figure 8:
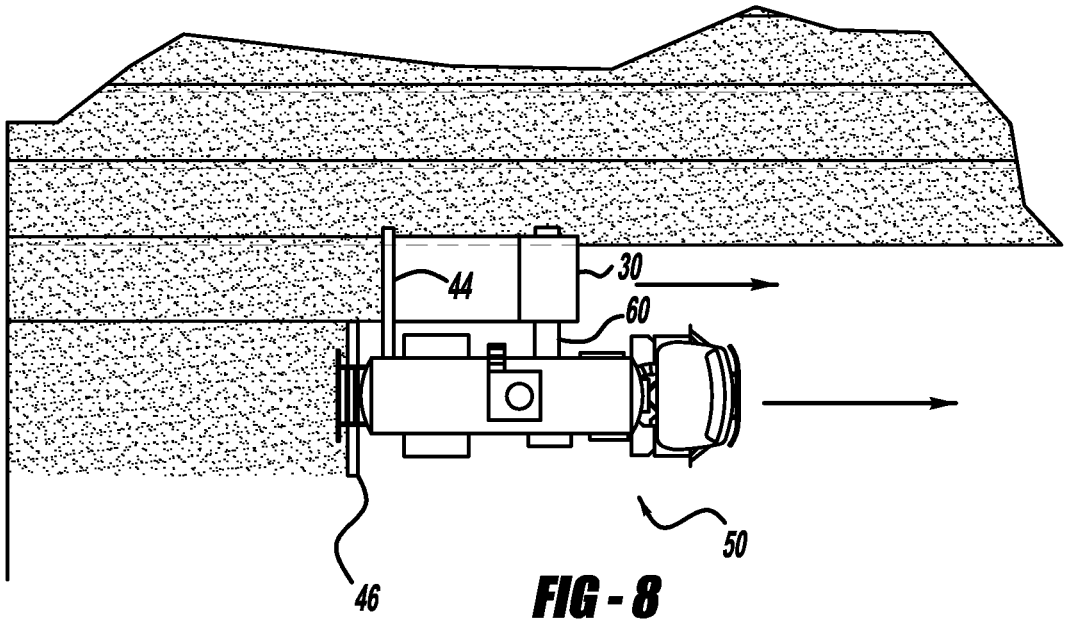
FIG. 8 is a top view of the apparatus as illustrated in FIG. 7.

FIGS. 6 and 7 illustrate alternate embodiments of the invention wherein the paper roll dispensing and water source are combined into one vehicle. For this purpose, an extended structure 60 is attached to the side or front end of the tanker truck. The extended structure 60 supports a rotatable axle rod 65 that supports the roll of paper 30. As the vehicle is rolled in a forward direction, the paper roll 30 dispenses a layer of paper 33 on the substrate 20. The water spray tubes 46 at the rear of the vehicle wet down the layer of paper. As in the preferred embodiments, the layer of paper is laid down in adjacent rows until the complete surface to be frozen is covered. Thereafter, a hydraulic lift mechanism lifts up the roll of paper and it is stored in a lifted condition until the tanker truck has completed spraying water over the completed frozen surface to build up the ice to its required thickness, that is, one and one-half inches to two inches. The savings materialized on a five acre surface area by the use of this inventive method over one season was approximately $63,000.00.

What is claimed is:

1. A method for creating and preserving an outdoor frozen surface, said method comprising the steps of:

defining an outdoor ground surface area;

covering said defined outdoor ground surface area with at least one layer of white base paper by using a roll of white base paper mounted between two spaced apart arms extending from the body of at least one motorized vehicle and laying said white base paper directly on the ground of said defined outdoor ground surface, whereby as said motorized vehicle traverses the complete defined outdoor ground surface area said roll of white base paper is unrolled from said two spaced apart arms to create adjacent rows of dispersed paper directly in contact with the ground of said outdoor ground surface to cover said complete defined outdoor ground surface area with said at least one layer of white base paper;

dispersing water at or near freezing conditions from said at least one motorized vehicle over said at least one layer of white base paper directly disposed on the ground and covering said defined outdoor ground surface area to saturate said at least one layer of white base paper whereby said water dispersed from said at least one motorized vehicle will freeze into a layer of ice to hold said at least one layer of white base paper to said defined outdoor ground surface area;

continue dispersing said water under freezing conditions from said at least one motorized vehicle onto said defined outdoor ground surface area to build up a predetermined thickness of said ice layer on said defined outdoor ground surface area.

2. The method as claimed in claim 1 further comprising the step of:

clearing debris, litter and stones from said defined outdoor ground surface area whereby protrusions which may present a hazardous condition in an ice surface are removed from said defined outdoor ground surface area prior to covering said defined outdoor ground surface area with said at least one layer of white base paper.

3. The method as claimed in claim 1 wherein said step of defining an outdoor ground surface area results in defining a dirt ground surface area.

4. The method as claimed in claim 3 further comprising the step of dispersing water from said at least one motorized vehicle at or near freezing conditions on said defined dirt ground surface area prior to covering said defined dirt ground surface area with said white base paper but after said clearing step so as to create a layer of frozen dirt upon which said white base paper is laid by said at least one motorized vehicle during said covering step.

* * * * *